US005168696A

United States Patent [19]

Stahlecker

[11] Patent Number: 5,168,696

[45] Date of Patent: Dec. 8, 1992

[54] ARRANGEMENT FOR CONVEYING PACKAGES AWAY FROM A SPINNING MACHINE

[75] Inventor: Gerd Stahlecker, Eislingen/Fils, Fed. Rep. of Germany

[73] Assignees: Fritz Stahlecker; Hans Stahlecker, both of Fed. Rep. of Germany

[21] Appl. No.: 719,009

[22] Filed: Jun. 21, 1991

[30] Foreign Application Priority Data

Jul. 20, 1990 [DE] Fed. Rep. of Germany ..... 4023087

[51] Int. Cl.[5] ..... D01H 9/04; B65G 47/30

[52] U.S. Cl. ..... 57/281; 57/90; 242/35.5 A; 198/418.6

[58] Field of Search ..... 198/427, 433, 801, 365, 198/327, 418.6; 242/35.5 A; 57/90, 281

[56] References Cited

U.S. PATENT DOCUMENTS

| | | | |
|---|---|---|---|
| 3,068,987 | 12/1962 | Franklin | 198/427 |
| 3,842,963 | 10/1974 | Reimper | 198/418.6 |
| 3,924,762 | 12/1975 | Igel | 57/281 X |
| 4,071,150 | 1/1978 | Thompson et al. | 57/281 X |
| 4,657,194 | 4/1987 | Wey et al. | 242/35.5 A |
| 4,723,885 | 2/1988 | Grube et al. | 242/35.5 A X |
| 4,830,171 | 5/1989 | Kupper | 198/357 |
| 4,877,121 | 10/1989 | Yamashita et al. | 198/801 X |
| 4,963,251 | 10/1990 | Bohm et al. | 198/365 X |
| 4,998,407 | 3/1991 | Matsui et al. | 57/281 X |

FOREIGN PATENT DOCUMENTS 3513003 10/1986 Fed. Rep. of Germany .

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

For a spinning machine, an arrangement is provided for the conveying of finished packages which, following an end of the spinning machine, comprises a transfer point for receiving a number of packages arranged behind one another in a row, which is followed by a stationary intermediate storage device for a plurality of rows of packages to which a removal device for the packages is assigned.

15 Claims, 2 Drawing Sheets

ARRANGEMENT FOR CONVEYING PACKAGES AWAY FROM A SPINNING MACHINE

BACKGROUND AND SUMMARY OF THE INVENTION

The invention relates to an arrangement for conveying finished packages away from a spinning machine, having a transfer point which connects to one end of the spinning machine and receives a number of packages behind one another in a row.

It is known (German Patent Document DE-A 35 13 003) to provide a groove at a front end of a spinning machine which serves as the collecting point and transfer point for a number of packages which are deposited on this groove in a row behind one another by a conveyor belt of the spinning machine. A movable travelling unit is assigned to this groove which can be applied to the groove and which in each case takes over a row of packages. The travelling unit will then, in each case, transfer one row of these packages to receiving containers of a suspended conveying device which then convey the packages to a central storage device. An arrangement of this type will no longer be usable when a spinning machine operates such that finished spun packages are present virtually simultaneously at all spinning points so that a large number of finished packages will be present. In addition, the known arrangement cannot be used in spinning machines where high delivery speeds are used so that packages appear at the individual spinning points which are finished relatively fast one after the other, so that, in this case also, a large number of finished packages will be present.

It is an object of the invention to provide an arrangement of the initially mentioned type by means of which, within a very short time period, a large number of finished packages may be conveyed away from a spinning machine.

This object is achieved according to preferred embodiments of the invention in that the transfer point is followed by a stationary intermediate storage device for a plurality of rows of packages to which a removal device for the packages is assigned.

Thus, according to the invention, a separate intermediate storage device is assigned to each spinning machine so that the spinning machine, in connection with the intermediate storage device, can empty itself without waiting for being serviced by a travelling unit. This arrangement is therefore also particularly suitable for an interconnection between the spinning machine and a further-processing machine, particularly for an interconnection of a spinning machine whose spinning points each produce two yarns which are wound side-by-side onto a cross-wound package. These cross-wound packages are subsequently fed to a twisting machine in which the final yarn product is produced. A spinning machine of this type operates at a significantly higher speed than a twisting machine so that one of these spinning machines is capable of servicing several twisting machines. Because of the intermediate storage device existing at the spinning machine, it is possible to supply these twisting machines automatically with finished packages in a suitable manner corresponding to the requirements.

Other objects, advantages and novel features of the present invention will become apparent from the following detailed description of the invention when considered in conjunction with the accompanying drawings.

DETAILED DESCRIPTION OF THE DRAWINGS

Figure 1:
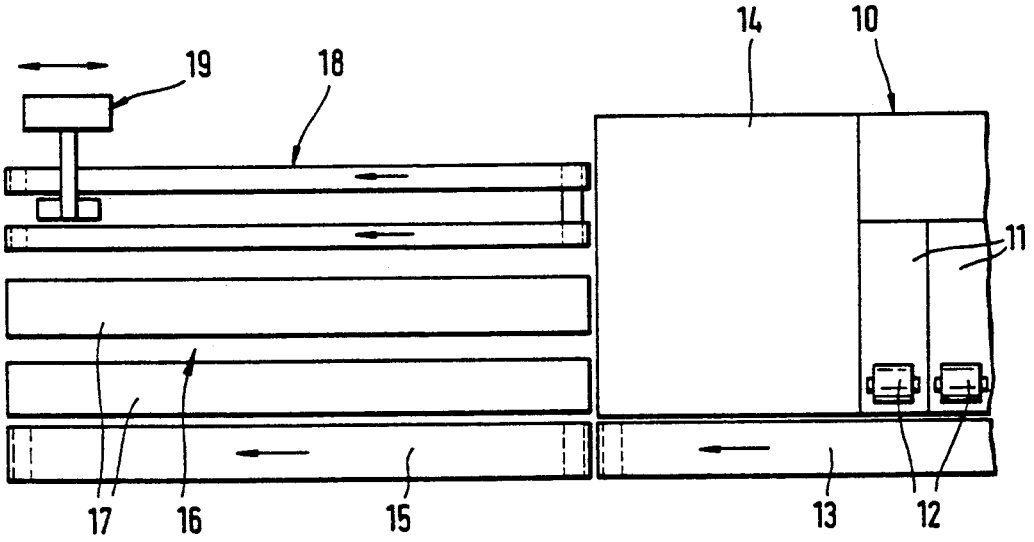
FIG. 1 is a schematic representation of a top view of a spinning machine for producing feed packages for twisting machines with an arrangement according to the invention arranged on one front end.

FIG. 1 illustrates the area of a front end of a spinning machine 10 which, on one side of the machine, has a plurality of spinning points or units 11 arranged in a row next to one another which each produce one package 12. The spinning machine 10 produces two yarns at each spinning point 11 which preferably are only prestrengthened and which are wound side-by-side on one package 12 respectively which is wound as a cross-wound package. These packages 12 are used as feeding packages for a twisting which is carried out on a twisting machine.

The spinning machine 10 operates at a very high delivery speed so that, within a relatively short time period, finished packages 12 are created behind one another at the individual spinning points 11. In addition, only relatively few yarn breakages occur so that the packages 12 of the individual spinning points are finished within a relatively narrowly limited frame. After the finishing of the packages 12, a package spool exchange will take place during which the finished packages 12 are removed and are replaced by empty spool tubes so that the spinning operation may be resumed or continued. The package / spool tube exchange can take place manually in a very simple manner. It is also contemplated to carry out this exchange of packages and tubes by means of a movable travelling unit which travels along the spinning machine 10 and correspondingly services the individual spinning points 11. The finished spools 12 are deposited on a conveyor belt 13 which moves in the bottom area of the machine 10 along this machine. The conveyor belt 13 is lengthened beyond the area of the spinning points 11 and moves to the front end of the machine 10, that is, up to the end of the head stock 14. As an extension of the conveyor belt 13, another conveyor belt 15 is arranged which takes over the fed packages 12 and which serves as a transfer point for an intermediate storage device 16. The intermediate storage device 16, in each case, takes over a row of packages 12 in troughs 17 which are a component of an elevator. A removal device 18 is assigned to the intermediate storage device 16 and receives one row respectively of the packages 12 deposited in the intermediate storage device 16 and carries them away or holds them ready to be carried away. In order to permit an individual moving-away of the packages 12, a separating device 19 is provided which—like the other structural components—will be explained in detail in the following. In a first embodiment, the separating device 19 is arranged in a stationary manner. It lifts the package which is applied to it off the removal device and holds it ready in a defined position for a transfer by a transfer device. In another embodiment, it is provided that the separating device 19 is a movable unit which can be moved along the removal device 18 as indicated by arrows, and which can be applied to a transport device which is not shown and which takes over the packages 12 and transports them to one or several twisting machines which are not shown.

A package 12, which is supplied to the machine end on the preferably groove-shaped conveyor belt 13, is recognized by a detector 20 preferably a light barrier detector. A control unit, with a specific time delay after detection of package 12 by detector 20, starts the switching-on of the conveyor belt 15 which will then take over the arriving package 12. A second detector 21, for example, also a light barrier, which is assigned to the conveyor belt 15, recognizes the entering of the package 12 and then interrupts the drive of the conveyor belt 15 until it is restarted by way of detector 20 which recognizes the next package 12. By means of this control, it is achieved that the packages 12 which, by means of their axes, are aligned in the longitudinal direction of the conveyor belts 13, 15, come to be situated at defined distances on the conveyor belt 15. An additional detector 22, preferably also a light barrier, detects when a defined number of packages 12 have been placed on the conveyor belt 15. The detector 22 reports to the control that the permissible number of packages 12 are now placed on the conveyor belt 15 so that then the drive of the conveyor belt 13 of the spinning machine 10 is interrupted. In addition, the conveyor belt 15 is then moved along until a fourth detector 23, preferably also a light barrier, reports that the packages 12 now take up the position on the conveyor belt 15 which is suitable for a transfer so that the drive of the conveyor belt 15 is interrupted. The control will then cause a transfer of the row of packages 12 to the intermediate storage device 16.

The intermediate storage device 16 is constructed as an elevator which comprises a plurality of troughs 24 aligned in parallel with respect to the conveyor belt 15. The troughs 24, the length of which corresponds to the length of a row of packages 12 disposed on the conveyor belt 15, are each fastened at their ends by means of two linked arms 27 to a toothed belt or a chain 26. The toothed belts or chains 26 each form vertically aligned loops which are guided around corresponding toothed belt disks or chain wheels 28 of which one is provided with a drive which is not shown. The number of troughs 24 is selected such that an intermediate storage capacity exists which is sufficient for a number of packages 12 which corresponds to the number of spinning points.

The troughs 24 have a C-shaped cross-section and are guided such that they are therefore open with respect to the conveyor belt 15 in the area of the upward moving belt end, while, in the area of the returning end, they are open in the direction of the removal device 18. The upper and lower walls 29 of the troughs 24 are each arranged at an angle of less than 90° with respect to the rear wall 30 so that the respective lower wall 29 projects diagonally upward from the rear wall 30 causing the packages 12 disposed in the troughs 24 to always rest against the rear wall 30.

For the transfer of the packages 12 to a trough 24 of the elevator, one of the troughs 24 is applied to the conveyor belt 15 by actuating the drive of the elevator. This may be triggered by a signal of the detector 23. Subsequently, the transfer of the packages 12 to the applied trough 24 takes place by tilting the conveyor belt 15 about its longitudinal axis so that the packages 12 disposed on it roll off into the trough 24. The conveyor belt 15 is held by means of a frame which, on its side facing the elevator, is disposed so that it can be swivelled about a shaft 33 extending in its longitudinal direction. The swivelling takes place by means of a pneumatic cylinder or hydraulic cylinder 32 which is applied to the frame 31. After the transfer of the packages 12, the conveyor belt 15 is tilted back into its initial position.

Figure 3:
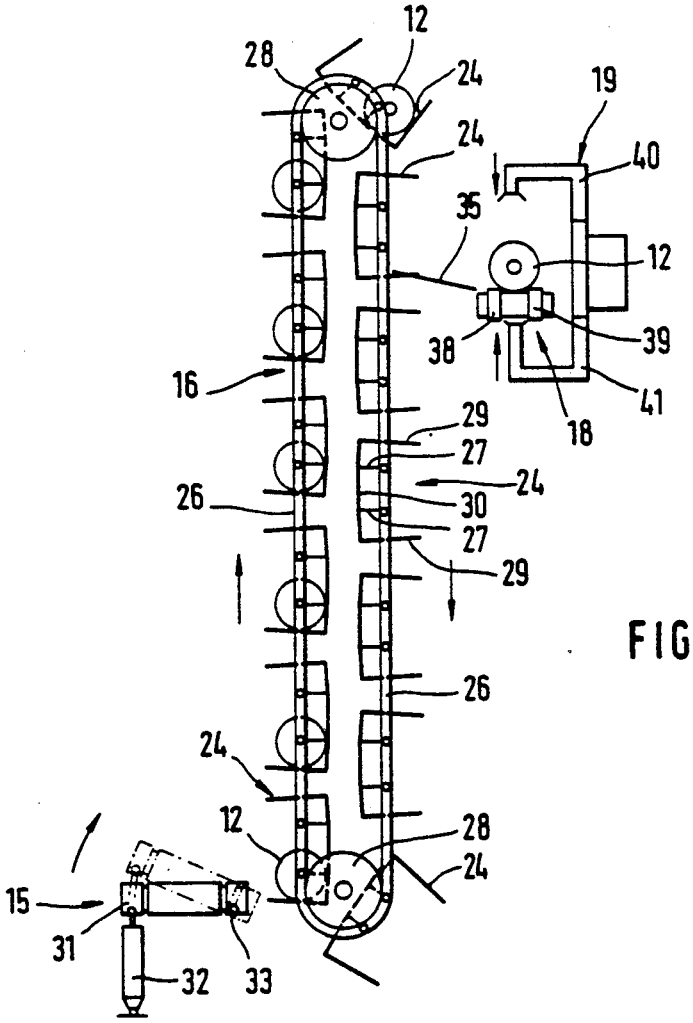
FIG. 3 is a view in the direction of the arrow II of FIG. 2.

A removal device 18 is assigned to the downward-moving end of the intermediate storage device 16 constructed as an elevator. In the embodiment according to FIG. 3, this removal device 18 is arranged relatively high, that is, shortly behind the upper linking point. For reasons of space, this may be expedient for the connection to another conveying device. However, in order to also fully utilize the storage capacity of the troughs 24 of the downward-moving end of the elevator, the removal device 18 may also be arranged farther below. As illustrated in FIG. 3, the troughs 24 are constructed mirror-symmetrically with respect to the horizontal line so that a package 12 received in them is held in the area of the ascending end as well as in the area of the descending end of the elevator.

Figure 2:
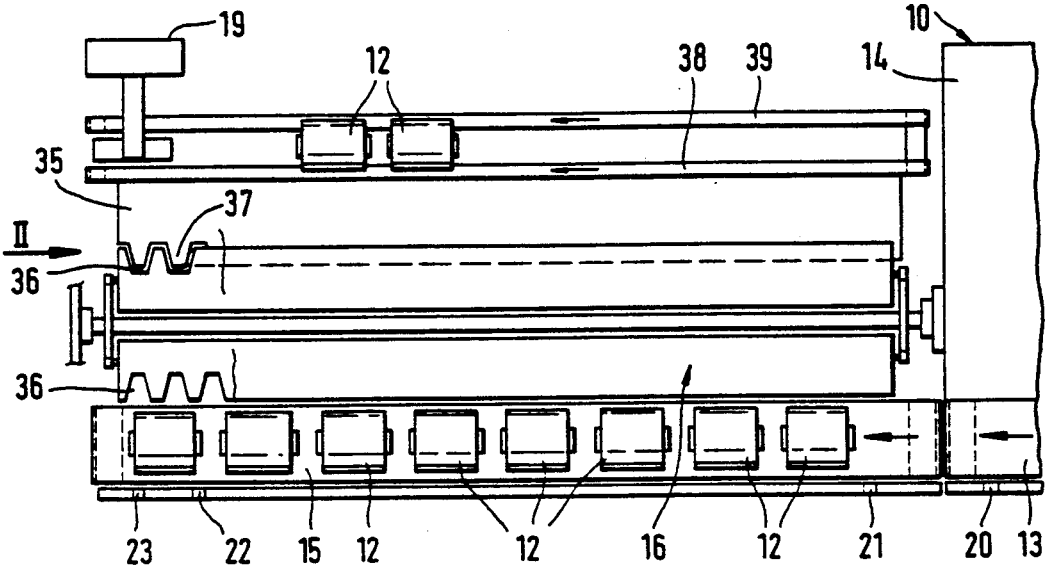
FIG. 2 is a slightly enlarged top view of the arrangement according to FIG. 1 which also shows additional details.

First, the removal device 18 comprises a removal element 35 which is slightly inclined with respect to the horizontal line and has the shape of a stationarily arranged plate. The upper and lower walls 29 of the troughs 24 are provided with comb-type recesses 36, as shown in FIG. 2. Prongs of a corresponding comb-type profiling 37 of the removal element 35 engage in these comb-type recesses 36. These profilings 36, 37 are so deep that the prongs 37 of the removal element 35 can securely grip the packages 12.

On the plate-shaped removal element 35, the packages 12 roll onto a depositing device formed of two conveyor belts 38, 39. The two conveyor belts 38, 39 extend in parallel to the removal element 35 and thus in parallel to the troughs 24. They leave a distance between one another which makes it possible to apply from above and below a gripping device 19 to the circumference of the packages 12 which is used as the separating device. The two conveyor belts 38, 39 each receive a row of packages 12 which are taken out of a trough 24. In a timed manner, they apply these packages 12 to the gripping device 19 which has two gripping arms 40, 41 which each receive a package 12 between one another between groove-shaped end parts. The gripping arms 40, 41 are driven in such a manner that they receive a package 12 between one another and lift it off the two conveyor belts 38, 39. This lifted-off end position is designed such that the two gripping arms 40, 41 have each moved on the whole by approximately the same distance so that the package center of the picked-up package 12, that is, its tube, is always situated at a defined point with respect to the gripping arms 40, 41 which is not dependent on the (accidental) diameter of the package 12. It is therefore possible, in this position of the gripping arms 40, 41, to apply to the package 12, that is, particularly to the spool tube, a receiving device which grips the package 12 on its spool tube.

In a modified embodiment, it is provided that the gripping device 19 can be moved in the longitudinal direction of the depositing device so that it can pick up the individual packages 12 always on the position on which they are is situated. Rods may then be provided instead of conveyor belts 38, 39. The gripping device 19 may then also be constructed such that it moves out of the area of the depositing device and transfers the packages 12 directly to a conveying device which carries out the transport of the packages 12 to the twisting machine. This conveying device may have spikes onto which the packages 12 are fitted. In another modification, it is also provided that the gripping device 19 carries out a movement about a horizontal axis so that it twists the packages 12 about this horizontal axis in such a manner that the packages 12 are aligned vertically and are fitted onto spikes in this position. In this case, it is possible to fit the packages 12 on spikes of individual plates on which the packages 12 are then brought to the twisting machines.

In a modified embodiment of the elevator, it is provided that the troughs 24 are replaced by saucer-shaped troughs which, in the manner of swings, are suspended such that, because of their weight and of the weight of the received packages 12, they always maintain their position in space, that is, also in the area of the two vertexes. In this case, it is possible to always utilize the whole elevator as an intermediate storage device 16, that is, to fill all troughs 24 disposed on it. In this case, a switchable removal element will then be expediently provided which is only applied to one of the troughs 24 when packages 12 contained in this trough 24 are to be transferred. This may, for example, be a plate-shaped element which is applied to the edge of such a trough 24 suspended in the manner of a swing and swivels it in such a manner that the packages 12 contained in it roll to the depositing device.

In another development, it is provided that the depositing device is already a conveyor belt which extends in parallel to the troughs 24 and which leads directly to one or several twisting machines without any previous displacing of the packages 12.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for conveying finished packages away from a spinning machine, comprising:

a transfer device which connects to one end of the spinning machine and receives a number of packages behind one another in a row, a stationary intermediate storage device for a plurality of rows of packages disposed downstream of the transfer device, and a removal device for removing the packages from the intermediate storage device, said removal device including a further moving conveyor for further conveying the spun yarn packages away from the intermediate storage device, wherein the transfer device is constructed as a transport element arranged as an extension of the spinning machine which can be tilted about its longitudinal axis by means of a tilting device for the simultaneous transfer of a row of packages to a receiving device of the intermediate storage device, and wherein the transport element is a conveyor belt which is arranged as an extension of a feeding device of the spinning machine which is used for feeding individual packages.

2. An arrangement for conveying finished packages away from a spinning machine, comprising:

a conveyor belt arranged as an extension of the spinning machine, which conveyor belt receives a row of spun yarn packages arranged behind one another from the spinning machine, a stationarily disposed intermediate storage device which has a plurality of receiving devices for receiving a plurality of rows of spun yarn packages, which receiving devices can be successively brought into position alongside the conveyor belt, a conveyor belt tilting device for tilting the conveyor belt about an axis extending in a longitudinal travel direction of the conveyor belt to thereby simultaneously deliver a row of packages from the conveyor belt to a respective receiving device of the intermediate storage device, and a removal device for removing packages from the intermediate storage device, said removal device including a further moving conveyor for further conveying the spun yarn packages away from the intermediate storage device.

3. An arrangement according to claim 2 wherein the intermediate storage device is constructed as an elevator which has a plurality of adjacent rows of the receiving devices which can be supplied together with one row of packages respectively by the conveyor belt when it is tilted by the belt tilting device.

4. An arrangement according to claim 3, wherein the receiving devices are each constructed as troughs which are approximately C-shaped in their cross-section, and an upper wall and a lower wall of which are each arranged at an angle of less than 90° with respect to the rear wall.

5. An arrangement according to claim 2, wherein the troughs are suspended on essentially vertically aligned flexible driving elements which travel over reversing and driving wheels.

6. An arrangement according to claim 4, wherein the upper and lower walls of the troughs have recesses in an area of which a removal element of the removal device can be inserted.

7. An arrangement according to claim 6, wherein the walls of the troughs are provided with comb-shaped prongs and recesses to which correspondingly offset comb-type prongs and recesses of the removal element are assigned.

8. An arrangement according to claim 6 wherein the removal element has the shape of a plate which is aligned in parallel to the longitudinal direction of the receiving devices of the elevator.

9. An arrangement according to claim 6, wherein a depositing device is arranged in parallel to the removal element and in each case takes over a row of packages.

10. An arrangement according claim 9, wherein the depositing device is constructed as a transport device.

11. An arrangement according to claim 10, wherein a separating device is assigned to the depositing device.

12. An arrangement according to claim 11, wherein the depositing device has two conveyor belts extending in parallel to one another which are spaced a distance from one another for accommodating a gripping device which can in each case be applied to a package.

13. An arrangement according to claim 9, wherein a separating device is assigned to the depositing device.

14. An arrangement according to claim 13, wherein the depositing device has two conveyor belts extending in parallel to one another which are spaced a distance from one another for accommodating a gripping device which can in each case be applied to a package.

15. An arrangement according to claim 9, wherein the depositing device has two conveyor belts extending in parallel to one another which are spaced a distance from one another for accommodating a gripping device which can in each case be applied to a package.

* * * * *